US012349752B2

(12) United States Patent
Khoshaba

(10) Patent No.: US 12,349,752 B2
(45) Date of Patent: Jul. 8, 2025

(54) GARMENT INTEGRATING FACE PROTECTION

(71) Applicant: Ashur Khoshaba, Startford (CA)

(72) Inventor: Ashur Khoshaba, Startford (CA)

( * ) Notice: Subject to any disclaimer, the term of this patent is extended or adjusted under 35 U.S.C. 154(b) by 135 days.

(21) Appl. No.: 18/168,349

(22) Filed: Feb. 13, 2023

(65) Prior Publication Data

US 2023/0255293 A1 Aug. 17, 2023

Related U.S. Application Data

(60) Provisional application No. 63/310,899, filed on Feb. 16, 2022.

(51) Int. Cl.
*A41D 1/02* (2006.01)
*A42B 1/0184* (2021.01)

(52) U.S. Cl.
CPC ..... *A42B 1/0184* (2021.01); *A41D 1/02* (2013.01); *A41D 2200/20* (2013.01)

(58) Field of Classification Search
CPC ..... A42B 1/0184; A42B 1/0181; A41D 1/02; A41D 2200/20
USPC ..... 2/195.7
See application file for complete search history.

(56) References Cited

U.S. PATENT DOCUMENTS

| | | | | |
|---|---|---|---|---|
| 3,858,242 | A * | 1/1975 | Gooding | A42B 3/225 2/427 |
| 4,247,960 | A * | 2/1981 | Nava | A42B 3/222 2/10 |
| 5,467,480 | A * | 11/1995 | Baudou | A42B 3/222 2/424 |
| 6,212,689 | B1 * | 4/2001 | Lee | A42B 3/326 2/424 |
| 6,263,509 | B1 * | 7/2001 | Bowen | A41D 13/05 2/84 |
| 6,301,721 | B1 * | 10/2001 | Arai | A42B 3/222 2/424 |
| 7,841,026 | B2 * | 11/2010 | Makris | B32B 27/00 2/412 |
| 2004/0199982 | A1 * | 10/2004 | Wang-Lee | A42B 3/225 2/10 |
| 2014/0352027 | A1 | 12/2014 | Galluzzo et al. | |
| 2016/0219961 | A1 | 8/2016 | Campos | |
| 2018/0070669 | A1 * | 3/2018 | Krick | A42B 3/221 |

FOREIGN PATENT DOCUMENTS

EP 1262113 12/2002

* cited by examiner

*Primary Examiner* — Timothy K Trieu

(57) ABSTRACT

A garment, comprising: a hood wearable on a head of an intended user; and a visor removably securable to the hood so as to be selectively positionable in front of at least part of a face of the intended user.

18 Claims, 4 Drawing Sheets

GARMENT INTEGRATING FACE PROTECTION

FIELD OF THE INVENTION

The present invention relates to the field of garments, and is more particularly concerned with a garment integrating face protection.

BACKGROUND OF THE INVENTION

Garments including hoods are often used by users wishing protection from cold weather or from precipitations. A disadvantage of such garments is that the user's face is then left exposed. Precipitations and wind can contact the face, which can produce uncomfortable or even dangerous cooling of the face's skin. Also, high speed winds, either real winds or apparent winds due to high speed movements through air, and precipitations entering the eyes can greatly reduce visibility. Face protection through a balaclava, glasses or similar devices can mitigate some of these disadvantages, but they are usually worn so that it is difficult to easily put them on and remove them quickly. They also can reduce the field of vision of the user.

Against this background, there exists a need in the industry to provide novel devices for protecting the face of an intended user.

SUMMARY OF THE INVENTION

In a broad aspect, there is provided a garment, comprising a hood wearable on a head of an intended user; and a visor removably securable to the hood so as to be selectively positionable in front of at least part of a face of the intended user.

In another broad aspect, there is provided a garment wearable by an intended user having a head, the head defining a face having eyes, the garment comprising: a hood for covering the head of the intended user, the hood defining a face aperture for receiving the face; and a visor removably securable to the hood so as to be selectively positionable across the face aperture.

There may also be provided a garment wherein, with the visor secured to the hood, the visor is pivotable between an extended position in which the visor is positioned across the face aperture, and a retracted position in which the visor is remains attached to the hood and is retracted at least in part from the face aperture.

There may also be provided a garment wherein, in the retracted position, the visor is in register with a top portion of the hood.

There may also be provided a garment wherein the hood defines a pair of laterally opposed side portions and a top portion extending therebetween, the face aperture being delimited at least in part by the side and top portions, the visor being adjacent the top portion in the extended position, the side portions having a lower portion thereof located below the visor.

There may also be provided a garment wherein the visor is further positionable at an intermediate position between the extended and retracted positions.

There may also be provided a garment further comprising a pair of attachments mounted to the hood opposed to each other across the face aperture, the visor being removably securable to the attachments.

There may also be provided a garment wherein the visor is clippable to the attachment.

There may also be provided a garment wherein the visor includes a visor body for extending across the face aperture and a pair of coupling sections extending from opposite ends of a visor body, and wherein each attachment includes a base fixedly secured to the hood and a lever pivotally mounted to the base, the lever defining a visor receiving portion opposed to the pivot to removably receive the coupling sections.

There may also be provided a garment wherein each coupling section includes a pair of prongs defining a gap therebetween, each prong defining a prong free end, the prong free ends converging towards each other across the gap, and wherein the visor receiving portion defines a protrusion, the protrusion being received in the gap when the visor is secured to the attachment.

There may also be provided a garment wherein the gap and the protrusion are substantially similarly shaped and sized.

There may also be provided a garment wherein the attachment section defines a pair of rails flanking the protrusion on opposite sides thereof each for receiving at least part of a respective one of the prongs.

There may also be provided a garment wherein the rails and the prongs are configured and sized so that the coupling section is fixed in rotation about the protrusion when the coupling section is received in the visor receiving portion.

There may also be provided a garment wherein the attachment further includes a pivot fixedly mounted to the base, the lever defining a pivot receiving portion receiving the pivot so that the pivot and the lever are rotatable relative to each other.

There may also be provided a garment wherein the pivot defines a plurality of recesses circumferentially spaced apart from each other, the lever defining a bump positioned so as to engage the recesses, wherein different ones of the recesses are engaged by the bump when the pivot and the lever body are rotated relative to each other.

There may also be provided a garment wherein the bump is defined by a flexible deformable beam.

There may also be provided a garment wherein the pivot includes a motion limiter configured to limit a range relative pivotal movements of the pivot and lever relative to each other through mechanical interference between the motion limiter and the lever.

There may also be provided a garment wherein the visor includes a pair of C-shaped clips and the attachment includes a protrusion for clipping the clips thereto.

There may also be provided a garment wherein the attachment includes a mating protrusion and recesses mechanism allowing to set the lever at discrete positions relative to the base.

There may also be provided a garment wherein the visor is substantially rigid. In other words, the visor maintains its shape when small forces are exerted thereonto, in opposition to a flexible visor that can be easily folded or deformed.

Advantageously, the proposed garment allows a lot of flexibility in the degree of protection provided to the face by the garment while allowing to change this degree of protection relatively quickly and efficiently.

Other objects, advantages and features of the present invention will become more apparent upon reading of the following non-restrictive description of preferred embodiments thereof, given by way of example only with reference to the accompanying drawings.

DETAILED DESCRIPTION

Terms such as "substantially", "about" and "essentially" may be used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Figure 1:
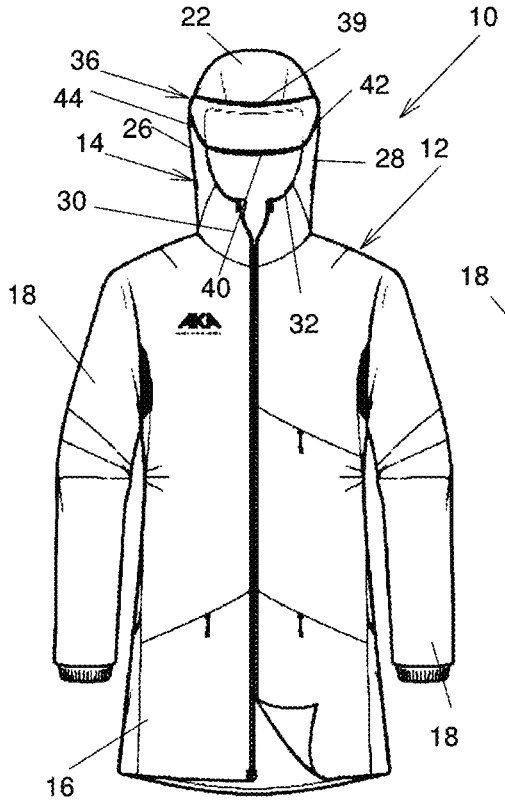
FIG. 1, in a front elevation view, illustrates a garment integrating face protection in the form of a visor in accordance with an embodiment of the present invention.
Figure 2:
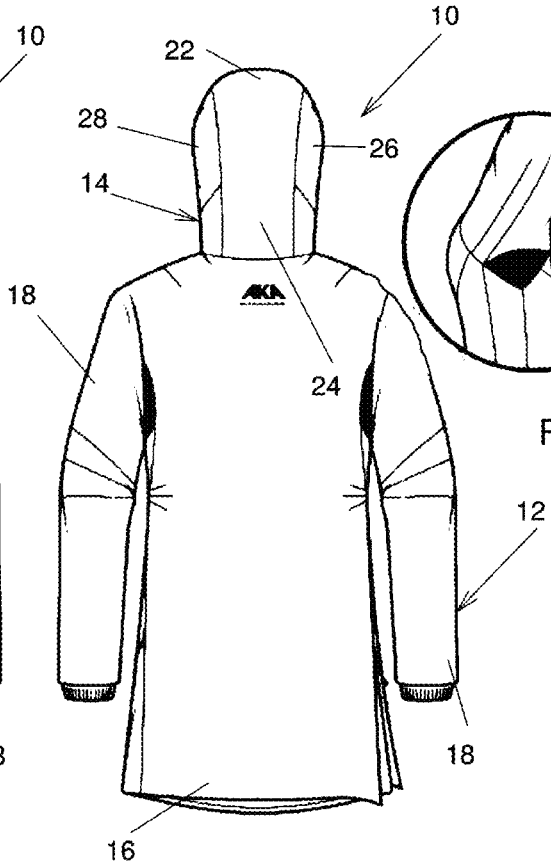
FIG. 2, in a rear elevation view, illustrates the garment of FIG. 1.
Figure 3:
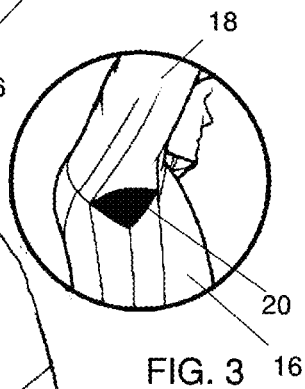
FIG. 3, in a side elevation view, illustrates an underarm portion of the garment of FIG. 1.

Referring collectively to FIGS. 1 and 2, there is shown a garment 10. The garment 10 is typically a coat, a jacket, or any similar garment. The garment 10 includes a lower portion 12 and a hood 14. The hood 14 is usable for covering the head 33 of an intended user and may be permanently secured to the lower portion 12, for example stitched thereto, or removable therefrom, for example by being secured thereto with snap fasteners or a zipper, among other possibilities. The lower portion 12 is for example a conventional jacket lower portion including a torso covering portion 16 and sleeves 18 extending therefrom. As seen in FIG. 3, in some embodiments, vents 20 are provided at the junction of the torso covering portion 16 and sleeves 18 so as to be in register with the underarm of a person wearing the garment 10.

Figure 4:
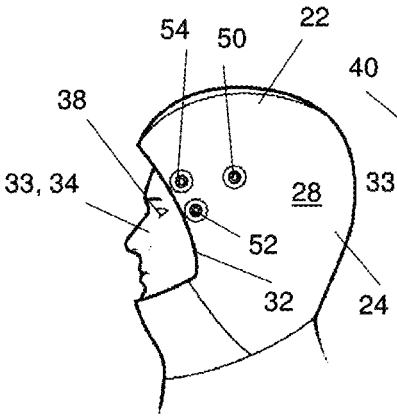
FIG. 4, in a side elevation view, illustrates a hood part of the garment of FIG. 1 with the visor removed therefrom.

The hood 14 includes a top portion 22 from which a back portion 24 and two side portions 26 and 28 extend downwardly, the back portion 24 extending between the side portions. In some embodiments, as seen in the drawings, the hood 14 also includes a front portion 30 extending between the side portions 26 and 28, below and spaced apart from the top portion 22. However, in other embodiments, the front portion 30 is omitted. The front portion 30 may be provided with a fastener, for example a zipper in continuity of a zipper part of the lower portion 12, allowing to selectively separate vertically two halves of the front portion 30 that extend respectively from each of the side portions 26 and 28. The top portion 26, side portions 26 and 28, and, when present, front portion 30 delimit a face aperture 32. When the hood 14 is worn over a head 33 of an intended user, the face 34 of the intended user is exposed through the face aperture 32, as seen in FIG. 4.

Figure 5:
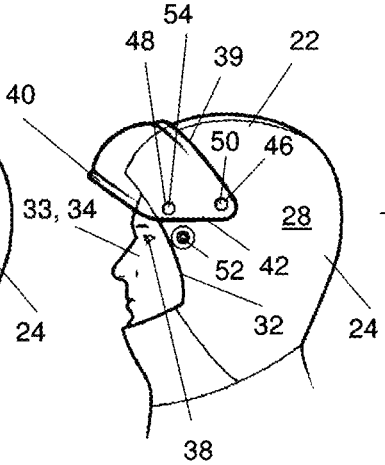
FIG. 5, in a side elevation view, illustrates the hood of FIG. 4 with the visor of FIG. 1 attached thereto in a retracted position.
Figure 6:
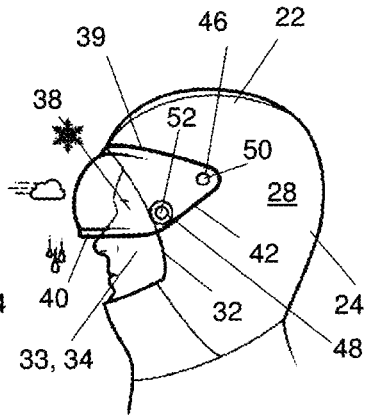
FIG. 6, in a side elevation view, illustrates the hood of FIG. 4 with the visor of FIG. 1 attached thereto in an extended position.
Figure 7:
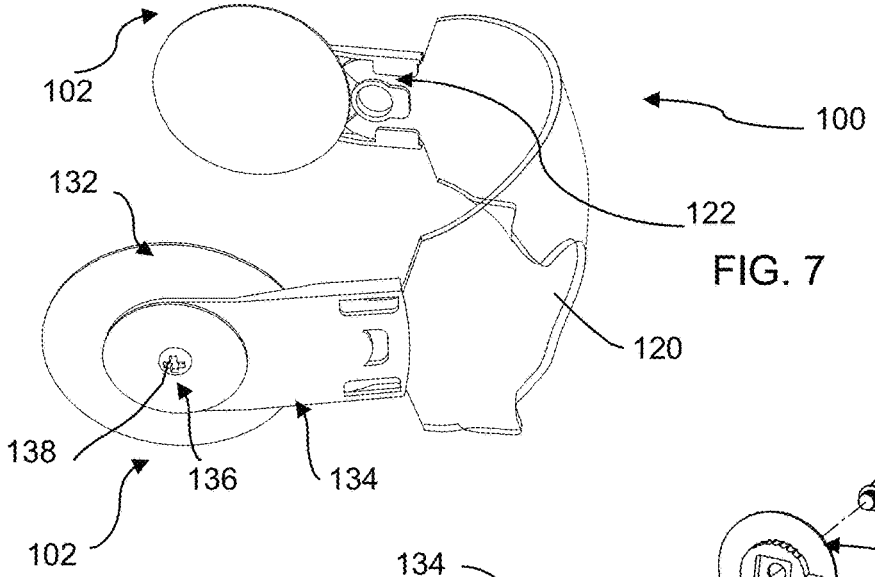
FIG. 7, in a perspective view, illustrates an alternative visor and attachment usable with the garment of FIG. 1.
Figure 8:
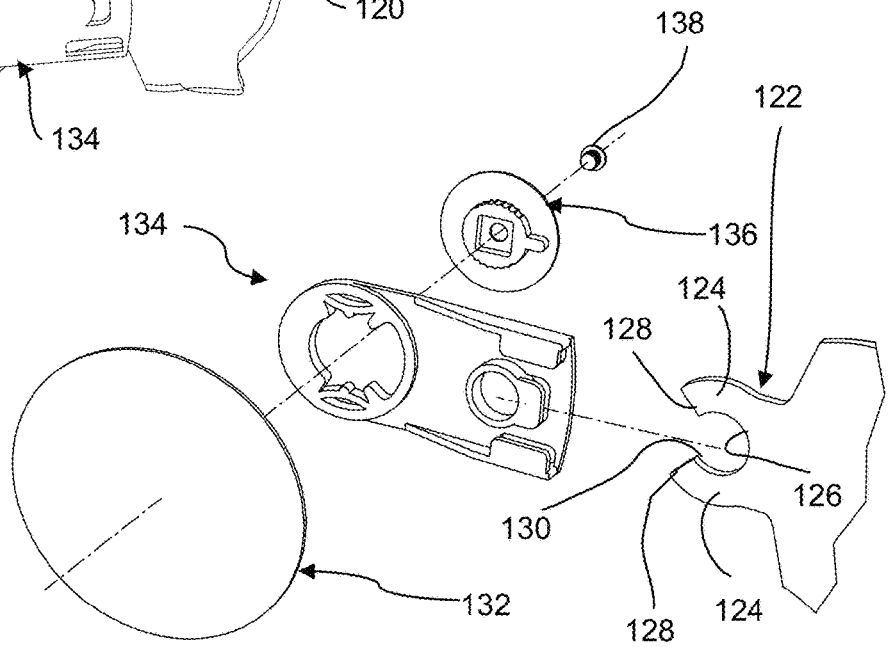
FIG. 8, in a perspective exploded view, illustrates the visor and attachment of FIG. 7.
Figure 9:
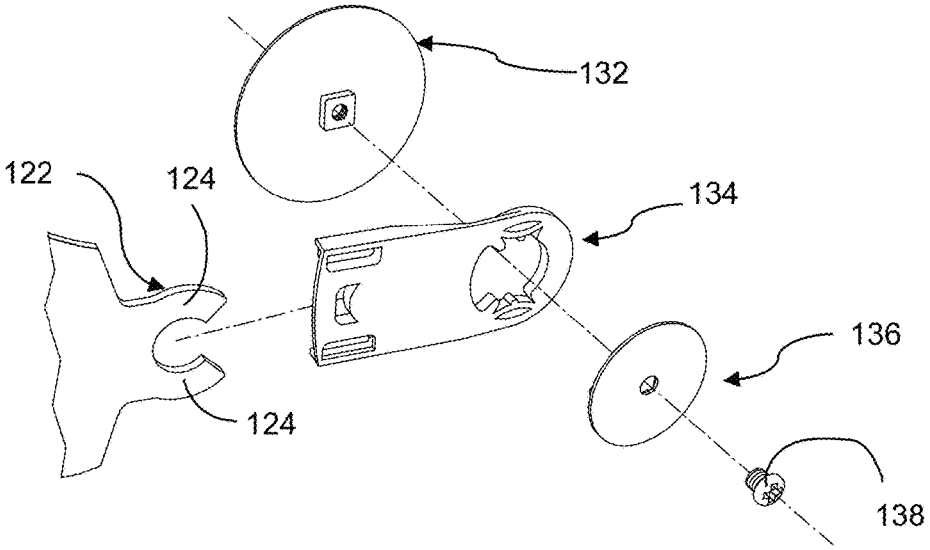
FIG. 9, in an alternative perspective exploded view, illustrates the visor and attachment of FIG. 7.

The garment 10 also includes a visor 36 (seen in FIG. 1 for example) removably securable to the hood 14 so as to be selectively positionable across the face aperture 32. Thus, the visor 36 is selectively positionable in front of at least part of the face 34 of the intended user. The visor 36 may be simply removably attachable statically to the hood 14. Alternatively, as seen in FIGS. 5 and 6, the visor 36 may be securable to the hood 14 so as to be movable between an extended position and a retracted position. In the extended position, as seen in FIG. 6, the visor 36 is positioned across the face aperture 32. For example, the visor 36 is adjacent the top portion 22 so as to be positioned in front of the eyes 38 of the intended user. In the retracted position, as seen in FIG. 5, the visor 36 remains attached to the hood 14 but is retracted from the face aperture 32, typically moved above the eyes 38, overlapping at least partially the top portion 22, and in some embodiments completely in register with the top portion 22. In some embodiments, the visor 36 is pivotable between the extended and retracted positions.

The visor 36 may cover entirely or partially the face aperture 32 in the extended position. In the retracted position, the visor 36 may be completely of partially retracted from the aperture 32. In some embodiments, the visor 36 is entirely transparent, with or without a tint. In alternative embodiments, only part of the visor 36 is transparent, including a portion thereof positioned in front of the eyes 38 in the extended position. In some embodiments, the visor 36 takes the form of a molded piece of polymer forming an arcuate shape extending over about 180 degrees horizontally. To minimize visual distortions, the visor 36 may also be curved vertically, so that the portion thereof through which one normally looks approximates a portion of sphere centered approximately at the retina of the intended user. However, other shapes are within the scope of the invention.

The visor 36 defines opposed top and bottom edges 39 and 40 and opposed side edges 42 and 44 extending therebetween. The top and bottom edges 39 and 40 are arcuate and the side edges 42 and 44 may be of any suitable shape, for example rectilinear. In some embodiments, the top edge 39 abuts against the hood 14 in the extended position, while the bottom edge 40 is spaced apart from the face 34 and only cover the upper portion thereof. This prevents rain or melted snow from entering the visor 36 from the top while providing sufficient air flow to reduce or prevent fogging, especially if the interior of the visor 36 is provided with an anti-fogging coating, or is made of a material that does not fog easily. Also, if the visor 36 is small enough, most or all of the air exhaled by the intended user will be redirected away from the interior of the visor 36, therefore further reducing the risks of fogging. Although not shown in the drawings, the visor 36 may be provided at the top edge 39 with a resiliently deformable material, such as a foam or rubber, to further enhance sealing between the visor 36 and the hood 14.

The visor 36 may be secured to the hood 14 in any suitable manner. For example, the visor 36 defines two mounting apertures 46 and 48 extending therethrough adjacent each side edge 42 and 44 (only the mounting apertures adjacent one of the side edges being shown in the drawings). The hood 14 also includes mounting studs 50, 52 and 54 extending outwardly therefrom and receivable in the mounting apertures 46 and 48. The mounting studs act as attachments to which the visor 36 is removably securable.

The rearmost stud 50 acts as a pivot point and remains engaged through the mounting aperture 46 that is closest to the top edge 39 when the visor 36 is moved between the extended and retracted positions. From the remaining studs, the one that is the lowest, stud 52, engages the other mounting aperture 48 in the extended position, and the other stud 54 engages the other mounting aperture 48 in the retracted position. Thus, the visor 36 may be securely mounted to the hood 14 in each of the retracted and extended positions.

The mounting studs 50, 52 and 54 may take the form of cylindrical pegs that are simply inserted in the mounting apertures 46 and 48. In other embodiments, the mounting studs 50, 52 and 54 define a small annular flange at their free end having an outer diameter slightly larger than a diameter of the mounting apertures 46 and 48, so that accidental removal of the visor 36 from the hood 14 is unlikely. In such embodiments, the mounting studs 50, 52 and 54 snap into the mounting apertures 46 and 48.

If the visor 36 is mountable statically to the hood 14, so that the visor 36 is not pivotable (not shown in the drawings), only two mounting studs 50 and 52 may be provided, each engaging a respective one of the mounting apertures 46 and 48 when the visor is mounted to the hood 14.

To ensure minimal movements of the visor 36 relative to the head 33, the hood 14 may be provided with drawstrings allowing tight fit to the head 33, or the hood 14 may be slightly rigid. Alternatively or in combination, the hood 14 may also be provided with an armature between the mounting studs 50, 52 and 54 of both sides to stabilize the position of the visor 36 relative to the head 33. In some embodiments, the hood is made of a fabric material.

In some embodiments, the mounting studs 50, 52 and 54 are provided with a base of a relatively large diameter at their junction with the hood 14. The mounting studs 50, 52 and 54 may also be linked to each other through a rigid member (not shown in the drawings) hidden in the hood 14, for example a substantially triangular plate from which the mounting studs 50, 52 and 54 protrude.

In use, the intended user would typically put on the garment 10 conventionally. Then, the visor 36 would be attached to the hood 14 in the desired position. Changing the position of the visor 36 only requires removing one of the mounting studs 52 or 54 from the mounting aperture 48 on each side of the visor 36, pivoting the visor 36 about the mounting aperture 46, and inserting in the mounting aperture 48 in the other mounting studs 52 or 54 on each side of the visor 36.

Referring to FIGS. 7 to 17 collectively, there is shown an alternative visor 100 and attachments 102 usable with the garment 10. The attachments 102 and the visor 100 are usable as replacement for the visor 36 and mounting studs 50, 52 and 54 in the garment 10. The attachments 102 are securable to the hood 14 on the side portions 26 and 28, for example adjacent to the location where the mounting studs 50, 52 and 54 are provided in the garment 10.

The visor 100 is removably securable to the attachments 102, which are mounted to the hood 14 opposed to each other across the face aperture 32. For example, the visor 100 is removably clippable to the attachments 102. To that effect, the visor 100 includes a visor body 120 for extending across the face aperture 32 and a pair of coupling sections 122 extending from opposite ends of a visor body 120. For example, each coupling section 122 is in the form of a substantially C-shaped clip. To that effect, each coupling section 122 includes a pair of prongs 124 defining a gap 126 therebetween. Each prong 124 defines a prong free end 128. The prongs 124 converge towards each other at the prong free ends 128 so as to define a gap entrance 130 leading into the gap 126. The gap entrance 130 is slightly narrower than a widest portion of the gap 126. In some embodiments, the gap is shaped similarly to a circular segment.

Referring to FIGS. 8, 9, 16 and 17 collectively, each attachment 102 includes a base 132 and a lever 134 pivotally mounted to the base 132. For example, a pivot 136 is used to couple to the base 132 and lever 134 to each other. In use, the base 132 is fixedly secured to the hood 14. In some embodiments, the lever 134, base 132 and pivot 136 are held together using a screw 138.

Figure 10:
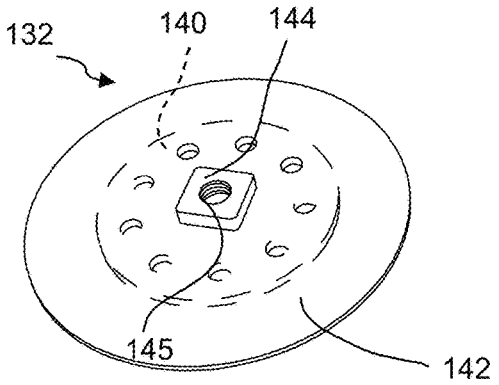
FIG. 10, in a perspective view, illustrates a base part of the attachment of FIG. 7.
Figure 16:
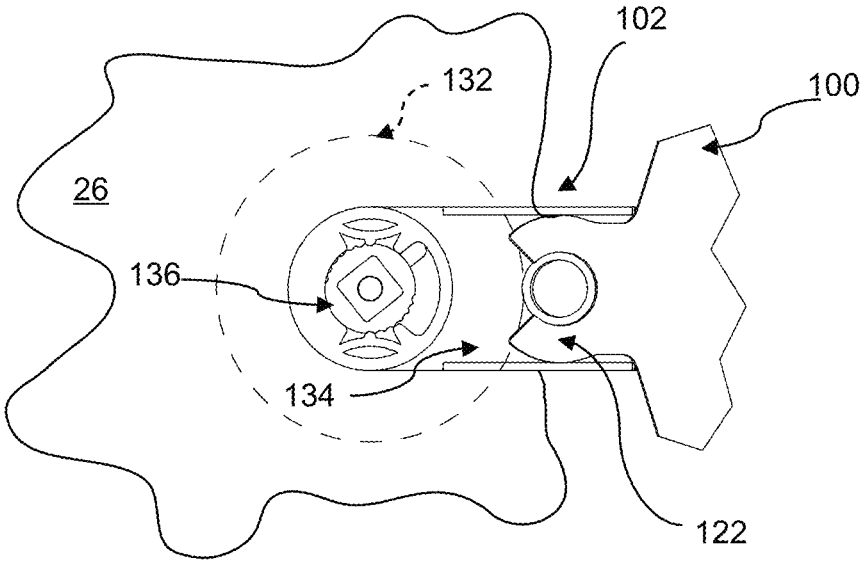
FIG. 16, in a partial side elevation view with parts removed, illustrates the attachment and visor of FIG. 7 with the attachment secured to a hood and the visor in an extended position.
Figure 17:
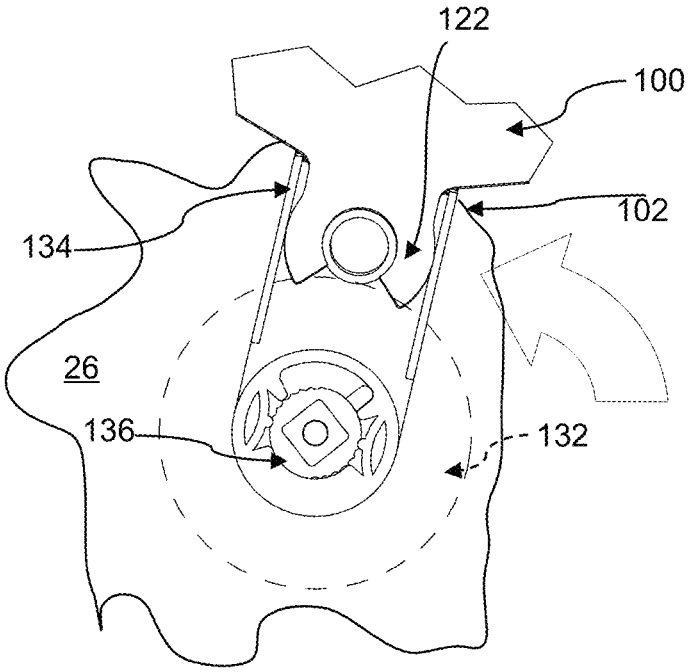
FIG. 17, in a partial side elevation view with parts removed, illustrates the attachment and visor of FIG. 7 with the attachment secured to a hood and the visor in a retracted position.

Referring to FIG. 10, the base 132 is generally disc-shaped and includes a core 140 mostly surrounded by, or embedded into, a peripheral portion 142. The core 140 is typically relatively rigid and defines a square peg 144 protruding axially from the remainder of the base 132, outside of the peripheral portion 142, facing the lever 134 and pivot 136. For example, the core 140 is made of a rigid polymer or of a metal. The square peg 144 defines an axial threaded aperture 145 for receiving the screw 138 thereinto. The peripheral portion 142 is mounted to the hood 14, and more specifically the side portions 26 and 28, as shown in FIGS. 16 and 17 for the side portion 26. In some embodiments, the peripheral portion 142 is made of silicone and sewn to the side portions 26 and 28. In some embodiments, the peripheral portion 142 is embedded in the side portions 26 and 28 so as to be hidden from view. While the peg 144 is square, other shapes that can be engaged while preventing rotation are also within the scope of the invention.

Figure 11:
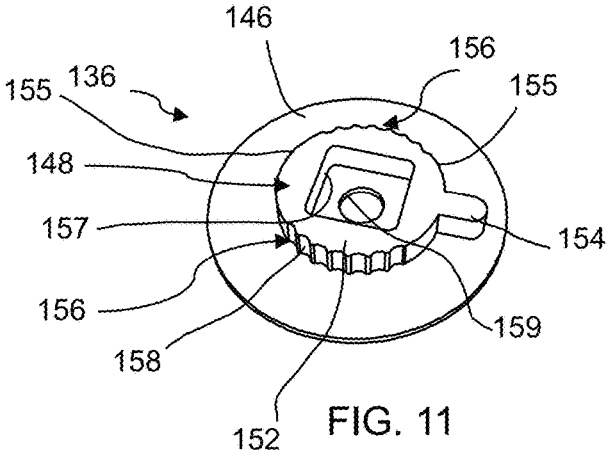
FIG. 11, in a perspective view, illustrates a pivot part of the attachment of FIG. 7.
Figure 12:
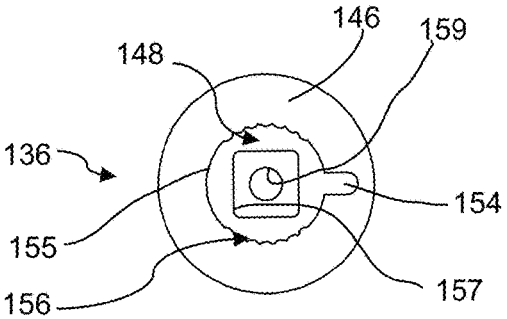
FIG. 12, in a top plan view, illustrates the pivot of FIG. 11.
Figure 13:
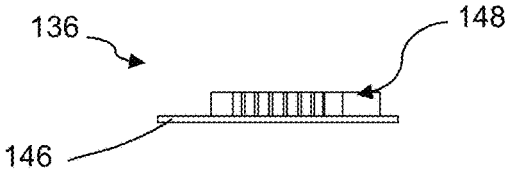
FIG. 13, in a side elevation view, illustrates the pivot of FIG. 11.

Referring collectively to FIGS. 11 to 13, the pivot 136 includes a disk 146 from which a motion limiter 148 extends axially. The motion limiter 148 is smaller in diameter than the disk 146 and centrally located relative thereto. The motion limiter 148 includes a central portion 152 of generally cylindrical configuration, from which extends a radially extending branch 154. Also, the central portion 152 has a peripheral wall defining a pair or arcuate undulating sections 156 diametrically opposed to each other, linked to each other through a pair of arcuate smooth sections 155, the branch 154 extending from one of the smooth sections 155. The adjectives smooth and undulating here refer to a texture of the circumferential peripheral surface of the motion limiter 148 in the corresponding sections. The undulating sections 156 define circumferentially spaced apart recesses 158. The motion limiter 148 also defines an axial square recess 157 configured to substantially snugly receive the square peg 144, and the disk 146 defines a through aperture 159 in register with the square recess 157 to receive the screw 138 therethrough.

Figure 15:
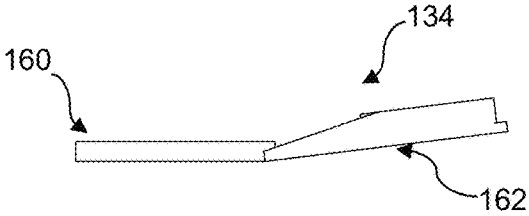
FIG. 15, in a side elevation view, illustrates the lever of FIG. 14.
Figure 14:
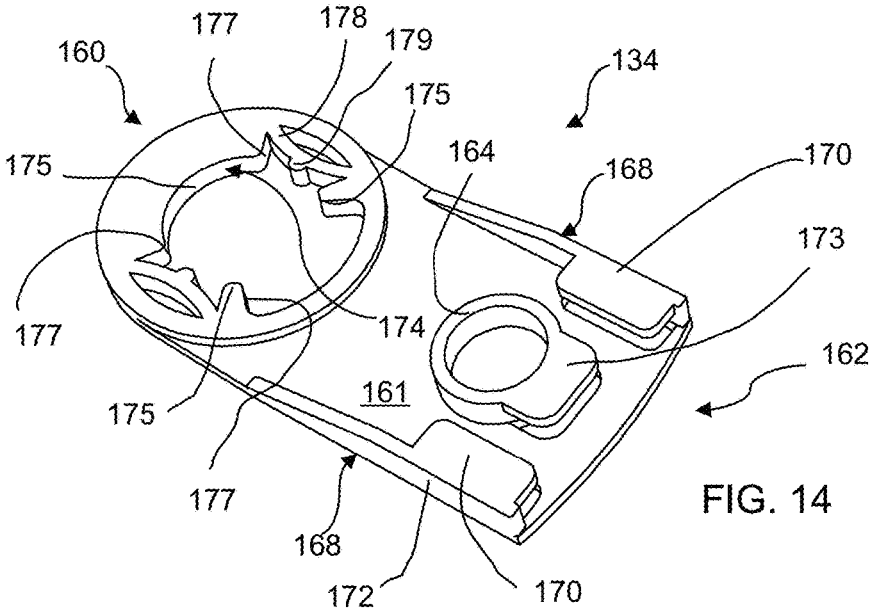
FIG. 14, in a perspective view, illustrates a lever part of the attachment of FIG. 7.

Referring to FIGS. 14 and 15 collectively, the lever 134 defines a pivot receiving portion 160 and a visor receiving portion 162 spaced apart from the pivot receiving portion 160. The visor receiving portion 160 is configured to removably receive the coupling sections 122. To that effect, the lever 134 defines a lever body 112, which is for example substantially plate-shaped and from which a cylindrical protrusion 164 protrudes from an inner surface 161 thereof. The inner surface 161 faces the base 132 when the lever 134 is mounted thereto. The protrusion 164 is configured to be substantially snugly received in the gap 126. The protrusion 164 is flanked by a pair of rails 168 also extending from the inner surface 161 configured for receiving the prongs 124 thereinto. Each rail 168 includes an end wall 170 spaced apart and substantially parallel to the inner surface 161 and a spacing wall 172 extending between the end wall 170 and the lever body 112. In some embodiments, a ledge 173 also protrudes from the protrusion 164, also substantially parallel to and spaced apart from the inner surface 161.

Thus, with the prongs 124 received in the rails 168 and the protrusion 164 received in the gap 126, the visor receiving portion 162 and the coupling section 122 are secured to each other. The ledge 173 and end wall 170, along with the inner surface 161 maintain the prongs 124 parallel to the lever body 112. Since the gap entrance 130 is slightly smaller than the protrusion 164, the prongs 124 clip to the protrusion 164 to ensure that the visor 100 cannot be removed from the attachment 102 unless a predetermined conveniently selected force is exerted. This force typically requires a slight deformation of the prongs 124 and/or protrusion 164 to create a clipping action. Finally, rotation about the protrusion 164 of the prongs 124 is prevented through mechanical interference between the spacing walls 172 and the laterally outwardmost edges of the prongs 124.

The pivot receiving portion 160 defines a pivot receiving aperture 174 for receiving the receiving the motion limiter 148 thereinto. The pivot receiving aperture 174 is smaller than the disk 146, so that when the attachment 102 is fully assembled, the pivot receiving portion 160 is between the disk 146 and the base 132. The pivot receiving aperture 174 is delimited partially by smooth arcuate walls 175 of configuration similar to that of the smooth sections 155 of the motion limiter 148. The smooth arcuate walls 175 are interrupted by three gaps 177. A first one of the gaps 177 receives the branch 154 and limits rotations of the motion limiter 148 as the branch 154 reaches each extremity of this gap 177. The other two gaps 177 are diametrically opposed to each other and receive each a flexible beam 178. Each beam 178 defines a bump 179 at a central location of the gaps 177. The bump 179 is configured to engage the recesses 158, so that the pivot 136 can retain the lever 134 at discrete positions as the lever 134 pivot about the base 132 as the lever 134, through the bumps 179, engages successive recesses 158. Therefore, the bumps 179 and the recesses 158 create a mating protrusion and recesses mechanism allowing to set the lever 134 at discrete positions relative to the base 132. In this embodiment, the visor is therefore positionable at an intermediate position between the extended and retracted positions and is maintained at the intermediate position unless a predetermined external force is exerted thereonto.

When the attachment 102 is fully assembled, the lever 134, and more precisely the pivot receiving portion 160, is positioned between the disk 146 and the base 132. The motion limiter 148 is engaged in the pivot receiving aperture 174 and the axial square recess 157 receives the square peg 144. Also, the screw 138 has its threaded shaft engaged through aperture 159 the and is screwed in the axial threaded aperture 145, with its head abutting against the disk 146 so as to maintain the attachment 102 assembled. The lever 134 is then able to pivot relative to the pivot 136 to achieve the extended and retracted positions, as well as intermediate positions therebetween corresponding to engagement of the bump 157 in successive recesses 158. As seen when comparing FIGS. 16 and 17, during this pivotal movement, the lever 134 pivots about the pivot 136. Therefore, the branch 154 remains fixed relative to the base 132, and opposite ends of the gap 177 receiving the branch 154 abut thereagainst to limit this pivotal movement.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A jacket wearable by an intended user having a torso from which arms extend and a head, the head defining a face having eyes, the jacket comprising:

a lower portion including a torso covering portion and sleeves extending from the torso covering portion for covering respectively the torso and arms of the intended user;

a hood secured to the lower portion for covering the head of the intended user, the hood defining a face aperture for receiving the face;

a visor removably secured to the hood so as to be selectively positioned across the face aperture; and a pair of attachments mounted to the hood opposed to each other across the face aperture, the visor being removably secure to the attachments;

wherein the visor includes a visor body for extending across the face aperture and a pair of coupling sections extending from opposite ends of the visor body, and wherein each attachment includes a base fixedly secured to the hood and a lever pivotally mounted to the base through a pivot fixedly mounted to the base, the lever defining a visor receiving portion opposed to the pivot to removably receive the coupling sections.

2. The jacket as defined in claim 1, wherein the visor is pivotable between an extended position in which the visor is positioned across the face aperture, and a retracted position in which the visor is remains attached to the hood and is retracted at least in part from the face aperture.

3. The jacket as defined in claim 2, wherein, in the retracted position, the visor is in register with a top portion of the hood.

4. The jacket as defined in claim 2, wherein the hood defines a pair of laterally opposed side portions and a top portion extending therebetween, the face aperture being delimited at least in part by the side and top portions, the visor being adjacent the top portion in the extended position, the side portions having a lower portion thereof located below the visor.

5. The jacket as defined in claim 2, wherein the visor is pivotable between the extended and retracted positions while remaining attached to the hood.

6. The jacket as defined in claim 1, wherein the visor is clippable to the attachments.

7. The jacket as defined in claim 6, wherein the visor includes a pair of C-shaped clips and the attachment includes a protrusion for clipping the clips thereto.

8. The jacket as defined in claim 1, wherein each coupling section includes a pair of prongs defining a gap therebetween, each prong defining a prong free end, the prong free ends converging towards each other across the gap, and wherein the visor receiving portion defines a protrusion, the protrusion being received in the gap when the visor is secured to the attachment.

9. The jacket as defined in claim 8, wherein the gap and the protrusion are substantially similarly shaped and sized.

10. The jacket as defined in claim 8, wherein the attachment section defines a pair of rails flanking the protrusion on opposite sides thereof each for receiving at least part of a respective one of the prongs.

11. The jacket as defined in claim 10, wherein the rails and the prongs are configured and sized so that the coupling section is fixed in rotation about the protrusion when the coupling section is received in the visor receiving portion.

12. The jacket as defined in claim 1, wherein the lever defines a pivot receiving portion receiving the pivot so that the pivot and the lever are rotatable relative to each other.

13. The jacket as defined in claim 12, wherein the pivot defines a plurality of recesses circumferentially spaced apart from each other, the lever defining a bump positioned so as to engage the recesses, wherein different ones of the recesses are engaged by the bump when the pivot member and the lever body are rotated relative to each other.

14. The jacket as defined in claim 13, wherein the bump is defined on a flexible beam.

15. The jacket as defined in claim 12, wherein the pivot includes a motion limiter configured to limit a range relative pivotal movements of the pivot and lever relative to each other through mechanical interference between the motion limiter and the lever.

16. The jacket as defined in claim 1, wherein the attachment includes a mating protrusion and recesses mechanism allowing to set the lever at discrete positions relative to the base.

17. The jacket as defined in claim 1, wherein the visor is substantially rigid.

18. A jacket wearable by an intended user having a torso from which arms extend and a head, the head defining a face having eyes, the jacket comprising:

a lower portion including a torso covering portion and sleeves extending from the torso covering portion for covering respectively the torso and arms of the intended user;

a hood secured to the lower portion for covering the head of the intended user, the hood defining a face aperture for receiving the face;

a visor removably secured to the hood so as to be selectively positionable across the face aperture; and a pair of attachments mounted to the hood opposed to each other across the face aperture, the visor being removably securable to the attachments wherein the visor is clippable to the attachments;

further wherein the visor includes a pair of C-shaped clips and the attachment includes a protrusion for clipping the clips thereto.

* * * * *